US005530990A

United States Patent [19]

Chen

[11] Patent Number: 5,530,990

[45] Date of Patent: Jul. 2, 1996

[54] HANDLE ASSEMBLY FOR SUITCASE

[76] Inventor: Shou-Mao Chen, 58 Ma Yuan West St., Taichung, Taiwan

[21] Appl. No.: 412,902

[22] Filed: Mar. 27, 1995

[51] Int. Cl.[6] ..... A45C 13/22

[52] U.S. Cl. ..... 16/115; 190/39; 280/655.1; 74/557; 74/527

[58] Field of Search ..... 190/39, 115; 16/115; 280/655, 655.1, 47.315, 47.371; 70/208; 292/DIG. 31, 152

[56] References Cited

U.S. PATENT DOCUMENTS 3,109,687 11/1963 Dereng ..... 16/115

3,572,870 3/1971 Marks et al. ..... 16/115

5,178,404 1/1993 Chen ..... 280/655.1

*Primary Examiner*—M. Rachuba

*Assistant Examiner*—Christopher Kirkman

[57] ABSTRACT

A handle for a suitcase includes a housing having a cavity for slidably receiving a plate and a hand grip. A spring member may bias the plate and the hand grip outward of the cavity. The housing includes a recess for receiving a catch which has a projection for engaging with the hand grip. The projection of the catch is engaged with the hand grip so as to retain the hand grip in the cavity of the housing and the spring member biases the hand grip and the plate outward of the cavity when the projection is disengaged from the hand grip.

1 Claim, 5 Drawing Sheets

HANDLE ASSEMBLY FOR SUITCASE

BACKGROUND OF THE INVENTION

1. Field of the Invention

The present invention relates to a handle, and more Particularly to a handle assembly for suitcase.

2. Description of the Prior Art

Typical handles for suitcases comprise a handle that may be engaged inwards of the suitcase and may be disengaged from and pulled outward of the suitcase for pulling the suitcases. However, normally, the suitcases comprise a rather complicated configuration therein for engaging with and for disengaging the handles.

The present invention has arisen to mitigate and/or obviate the afore-described disadvantages of the conventional handles for suitcases.

SUMMARY OF THE INVENTION

The primary objective of the present invention is to provide a handle assembly for a suitcase in which the handle assembly may be easily disengaged from the suitcase.

In accordance with one aspect of the invention, there is provided a handle assembly for suitcase comprising a housing including a cavity and two bases each having an aperture and each having a post, the housing including a middle portion having a recess communicating with the cavity, stop means secured to the posts, a plate slidably engaged in the cavity and including two end portions each having an orifice, the plate including a pair of studs for slidably engaging with the posts, the studs each including a ring for engaging with the stop means so as to limit sliding movement of the studs relative to the posts, means for biasing the plate outwards of the cavity, a hand grip including a pair of rods extended downward therefrom and extending through the orifices of the plate and extending inwards of the apertures of the housing, the hand grip including a notch, and a catch engaged in the recess of the housing and including a bottom portion secured in the housing, the catch including a knob formed in the upper portion and including a middle portion having a projection extended therefrom for engaging with the notch of the hand grip. The projection of the catch is engaged with the notch of the hand grip so as to retain the hand grip in the cavity of the housing when both the hand grip and the plate are depressed inwards of the cavity of the housing, and the biasing means biases the hand grip and the plate outward of the cavity of the housing when the projection is disengaged from the notch of the hand grip and when the knob of the catch is depressed.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
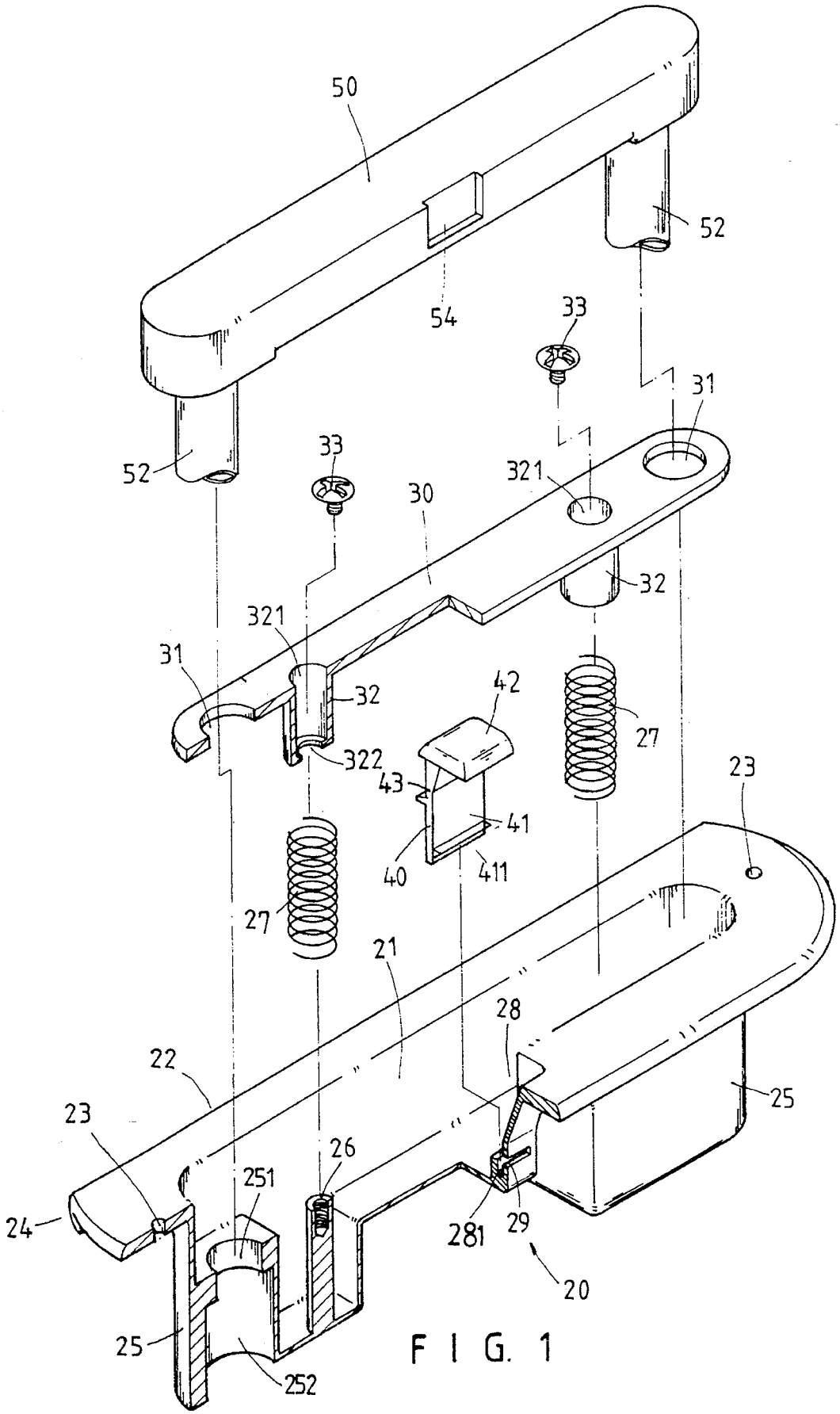
FIG. 1 is an exploded view of a handle assembly in accordance with the present invention.
Figure 2:
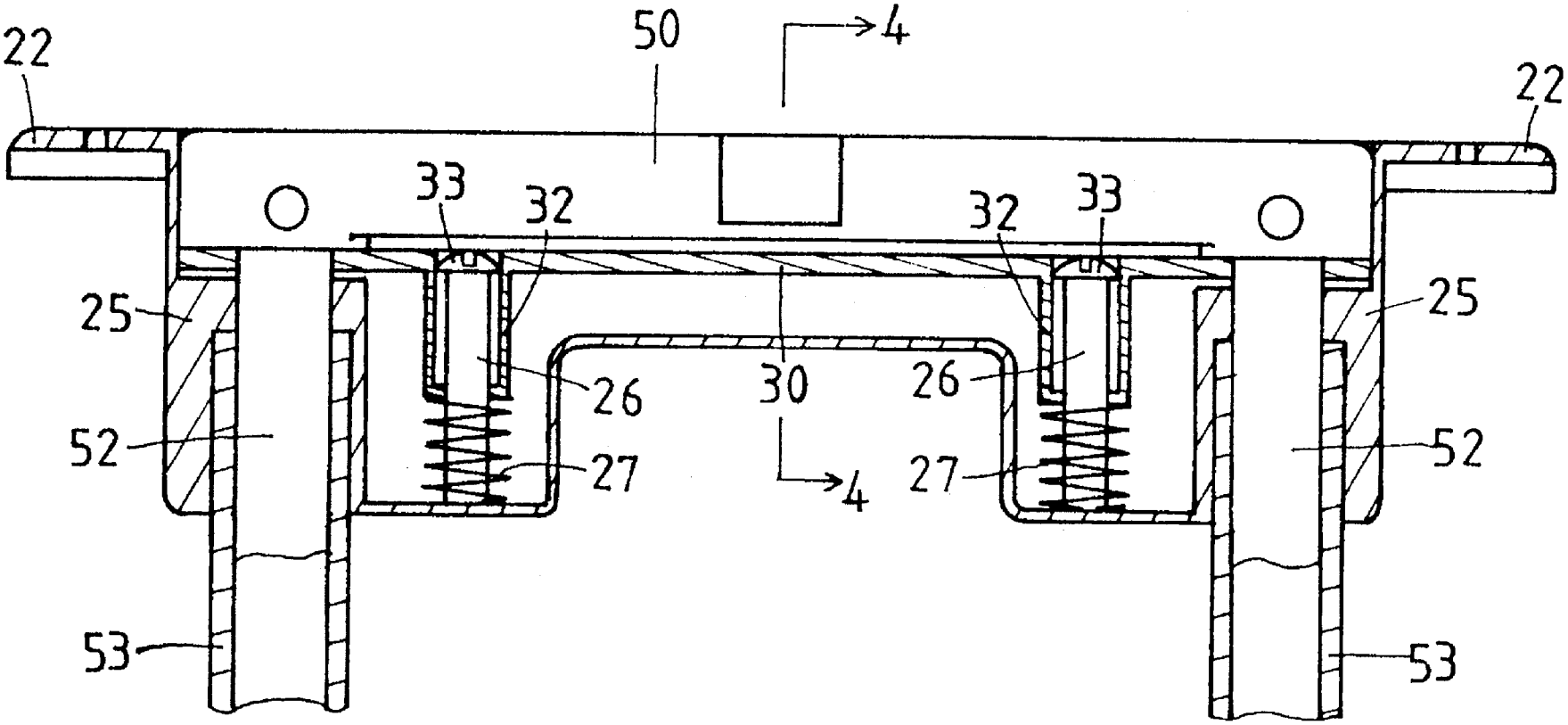
FIGS. 2 and 3 are cross sectional views taken along lines 2—2 of FIG. 4.

Referring to the drawings, and initially to FIGS. 1 and 2, a handle in accordance with the present invention comprises a housing 20 including a cavity 21 formed therein and including a peripheral flange 22 formed in the upper portion and having two holes 23 formed therein for fixing to the suitcases. The flange 22 includes an edge having a lip for engaging with the suitcases. The housing 20 includes a pair of bases 25 each having an aperture 251 formed therein and having an enlarged hole 252 formed therein for engaging With a tube, 53 which includes an inner diameter equals to that of the aperture 251. The bases 25 each includes a post 26 extended therein for engaging with a spring 27 and for fixing a screw 33 thereon. The housing 20 includes a middle portion having a recess 28 formed therein and communicating with the cavity 21 thereof. The housing 20 includes a partition 281 formed in the bottom portion of the recess 28 so as to, define a groove therein. A slot 29 is formed in the middle portion of time housing and communicating with the recess 28.

Figure 3:
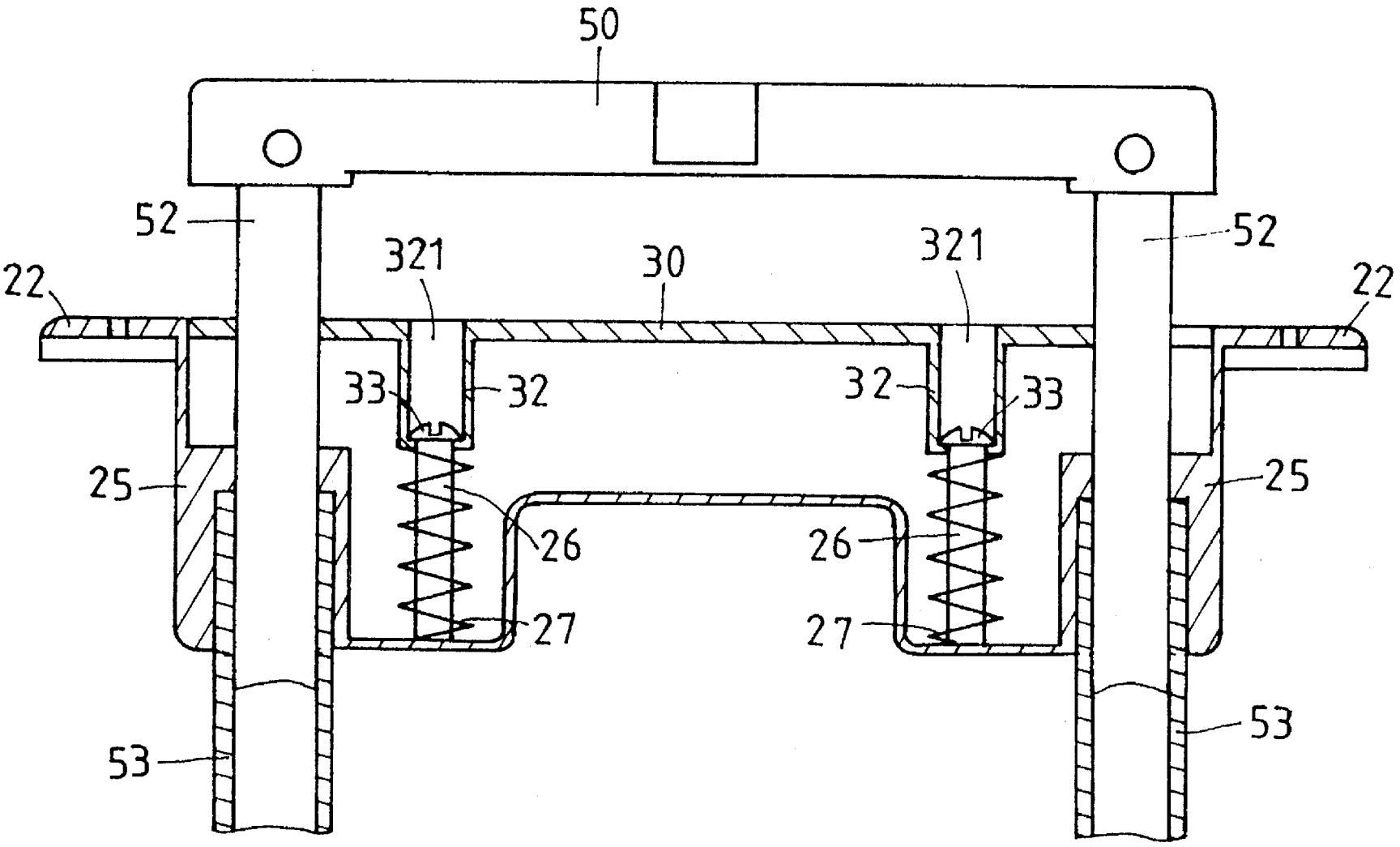
Figure 5:
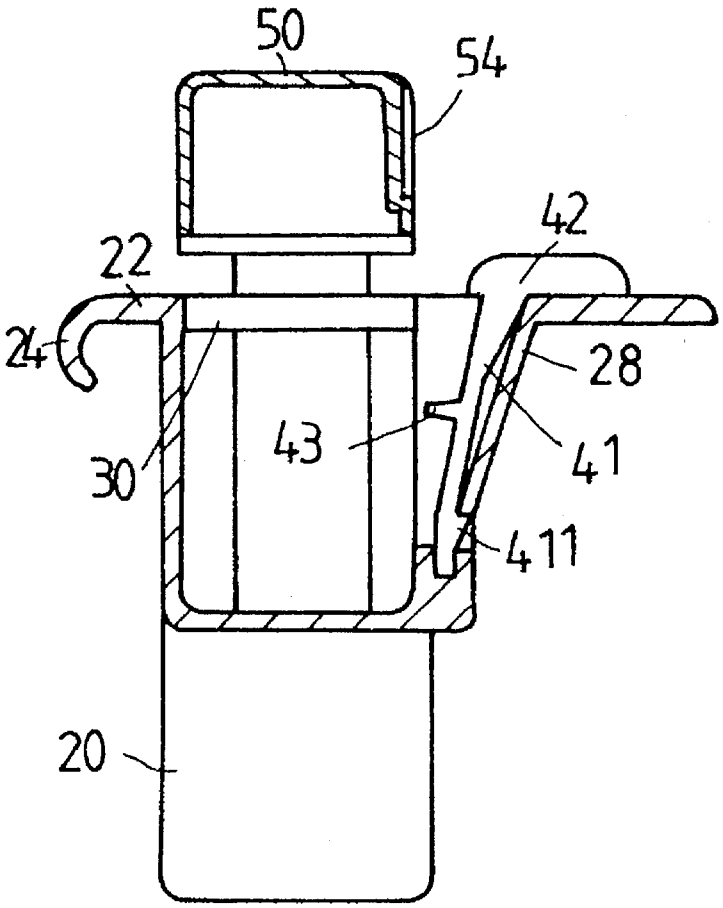

A plate 30 is slidably engaged in the cavity 21 and includes two orifices 31 formed in the end portions. The plate 30 includes two studs 32 extended downward therefrom and each having a bore 321 for slidably engaging with the posts 26. The studs 32 each includes a ring 322 extended radially inwards therefrom for engaging with the screw 33 so as to limiting the sliding movement of the plate 30 relative to the posts 26 and so as to prevent the plate 30 from disengaging from the housing 20. The springs 27 are engaged with the studs 32 for biasing the plate 30 upward to a position flush with the peripheral flange 22, best shown in FIGS. 3 and 5.

A hand grip 50 includes a pair of rods 52 extended downward therefrom for slidably engaging with the orifices 31 of the plate 30 and for slidably engaging with the apertures 251 and the tubes 53. The hand grip 50 includes a notch 54 formed therein. A catch 40 is engaged in the recess 28 of the housing 20 and includes a board 41 having a bottom portion engaged in the groove formed by the partition 281 and having a protrusion 411 extended from the lower end for engaging with the slot 29 of the housing 20 such that the catch 40 may be secured to the housing 20. The catch 40 includes a knob 42 provided on top thereof and includes a projection 43 laterally extended from the middle portion for engaging with the notch 54 of the hand grip 50 so as to retain the hand grip 50 within the cavity 21 of the housing 20.

Figure 4:
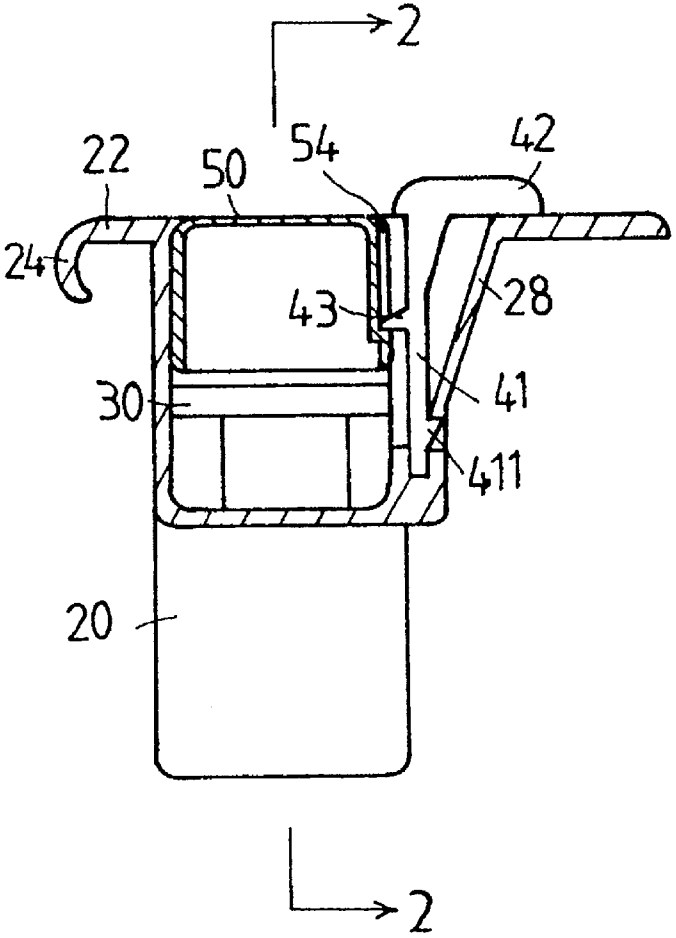
FIGS. 4 and 5 are cross sectional views taken along lines 4—4 of FIG. 2.

In operation, as shown in FIGS. 2 and 4, the hand grip 50 and the plate 30 may both be depressed inwards of the cavity 21 of the housing 20 until the projection 43 is engaged with the notch 54 of the hand grip 50 such that the hand grip 50 may be retained within the cavity 21 of the housing 20. When the knob 42 is depressed by the users in order to disengage the projection 43 from the notch 54, both the hand grip 50 and the plate 30 may be biased outward of the cavity 21 by the springs 27 such that the hand grip 50 may be easily pulled outward of the housing 20 by the users.

Accordingly, the handle assembly in accordance with the present invention includes a hand grip that may be retained within the housing and that may be biased outward of the housing when required.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A handle assembly for suitcase comprising:

a housing including a cavity formed therein and including two bases each having an aperture formed therein and each having a post extended therein, said housing including a middle portion having a recess formed therein and communicating with said cavity, stop means secured to said posts, a plate slidably engaged in said cavity of said housing and including two end portions each having an orifice formed therein, said plate including a pair of studs extended downward therefrom for slidably engaging with said posts, said studs each including a ring formed therein for engaging with said stop means so as to limit sliding movement of said studs relative to said posts, means for biasing said plate outwards of said cavity, a hand grip including a pair of rods extended downward therefrom and extending through said orifices of said plate and extending inwards of said apertures of said housing, said hand grip including a notch formed therein, and a catch engaged in said recess of said housing and including a bottom portion secured in said housing, said earth including an upper portion having a knob provided thereon and including a middle portion having a projection extended therefrom for engaging with said notch of said hand grip, said projection of said catch being engaged with said notch of said hand grip so as to retain said hand grip in said cavity of said housing when both said hand grip and said plate are depressed inwards of said cavity of said housing, and said biasing means biasing said hand grip and said plate outward of said cavity of said housing when said projection is disengaged from said notch of said hand grip and when said knob of said catch is depressed.

* * * * *